US012760893B2

(12) United States Patent
Blaauwwiekel et al.

(10) Patent No.: US 12,760,893 B2
(45) Date of Patent: Oct. 13, 2026

(54) METHOD AND CONTROLLER FOR OPERATING A GAS BURNER APPLIANCE

(71) Applicant: PITTWAY SARL, Rolle (CH)

(72) Inventors: Piet Blaauwwiekel, Sleen (NL); Uwe Deptolla, Lotte (DE)

(73) Assignee: PITTWAY SARL, Rolle (CH)

( * ) Notice: Subject to any disclaimer, the term of this patent is extended or adjusted under 35 U.S.C. 154(b) by 367 days.

(21) Appl. No.: 18/695,142

(22) PCT Filed: Sep. 7, 2022

(86) PCT No.: PCT/EP2022/074782
§ 371 (c)(1),
(2) Date: Mar. 25, 2024

(87) PCT Pub. No.: WO2023/046466
PCT Pub. Date: Mar. 30, 2023

(65) Prior Publication Data

US 2024/0401804 A1 Dec. 5, 2024

(30) Foreign Application Priority Data

Sep. 24, 2021 (EP) ..... 21198885

(51) Int. Cl.
*F23N 1/04* (2006.01)

(52) U.S. Cl.
CPC ..... *F23N 1/042* (2013.01); *F23N 2235/30* (2020.01); *F23N 2237/00* (2020.01); *F23N 2239/04* (2020.01)

(58) Field of Classification Search
CPC ..... F23N 1/0472; F23N 2235/30; F23N 2239/04; F23N 2237/00
(Continued)

(56) References Cited

U.S. PATENT DOCUMENTS 6,604,938 B1 8/2003 Blaauwwiekel et al.
9,134,026 B2 9/2015 Blaauwwiekel et al.
(Continued)

FOREIGN PATENT DOCUMENTS

DE 19824521 A1 12/1999
DE 19857239 A1 6/2000
(Continued)

OTHER PUBLICATIONS

International Search Report and Written Opinion in PCT International Application No. PCT/EP2022/074782 mailed Jan. 9, 2023.

*Primary Examiner* — Avinash A Savani
(74) *Attorney, Agent, or Firm* — Greenberg Traurig, LLP; Ryan Sharp; David J. Dykeman

(57) ABSTRACT

Method for operating a gas burner appliance (10), by providing during an actual burner-on-phase of the gas burner appliance (10) in request to an actual nominal heat demand a flow of a gas/air mixture (M) to a burner chamber (11), the gas/air mixture (M) having a defined mixing ratio of gas (G) and air (A), wherein said gas/air mixture (M) is provided by a mixing device (25) mixing an air flow with a gas flow, wherein the air flow or the flow of the gas/air mixture is provided by a fan (14) in such a way that a fan speed of the fan (14) depends on the actual nominal heat demand, wherein the fan speed range of the fan (14) defines a modulation range of the gas burner appliance (10), wherein said defined mixing ratio of gas (G) and air (A) of the gas/air mixture (M) is controlled by a controller (26) using as input a signal provided by a sensor (13) and providing as output a control variable for an electric or electronic gas flow modulator (18) in order to keep the mixing ratio of gas (G) and air (A) at the defined mixing ratio over the modulation range of the gas burner appliance (10). If the actual nominal heat demand of the gas burner appliance (10) is no longer present the following steps are automatically executed in
(Continued)

order to set-up the gas burner appliance (10) for an upcoming burner start: Decrease during the actual burner-on-phase the fan speed of the fan (14) to a defined fan speed while keeping the mixing ratio of gas (G) and air (A) of the gas/air mixture (M) at the de-fined mixing ratio thereby decreasing the opening position of the gas flow modulator (18). Keep the gas flow modulator (18) at said decreased opening position and terminate the actual burner-on-phase of the gas burner appliance (10).

11 Claims, 2 Drawing Sheets

(58) Field of Classification Search
USPC ..... 431/12
See application file for complete search history.

(56) References Cited

U.S. PATENT DOCUMENTS

| | | | |
|---|---|---|---|
| 10,247,416 | B2 | 4/2019 | Munsterhuis et al. |
| 10,520,186 | B2 | 12/2019 | Langius et al. |
| 11,287,131 | B2 | 3/2022 | Blaauwwiekel |
| 2015/0354809 | A1 | 12/2015 | Doura et al. |
| 2019/0017700 | A1* | 1/2019 | Shiba ..... F23D 14/64 |
| 2023/0090905 | A1 | 3/2023 | Deptolla |
| 2024/0393014 | A1 | 11/2024 | Deptolla et al. |
| 2025/0146583 | A1 | 5/2025 | Deptolla et al. |

FOREIGN PATENT DOCUMENTS

| | | | |
|---|---|---|---|
| DE | 19922226 | C1 | 11/2000 |
| DE | 10335310 | B3 | 6/2004 |
| DE | 102010054807 | A1 | 7/2015 |
| EP | 1215440 | A2 | 6/2006 |
| EP | 1248044 | B1 | 5/2008 |
| EP | 3699492 | A1 | 5/2009 |
| EP | 1515089 | B1 | 2/2010 |
| EP | 2667097 | A1 | 11/2013 |
| EP | 2685168 | A1 | 10/2015 |
| EP | 2685167 | A1 | 12/2015 |
| EP | 2685169 | A1 | 10/2018 |
| EP | 2653215 | A1 | 1/2020 |
| EP | 2985529 | A1 | 1/2020 |
| EP | 2623865 | A1 | 4/2020 |
| EP | 3477201 | A1 | 5/2020 |
| EP | 3415817 | A1 | 9/2020 |
| JP | H09210349 | A | 8/1997 |
| JP | 2800474 | B2 | 9/1998 |
| WO | 2021078949 | A1 | 4/2021 |

* cited by examiner

METHOD AND CONTROLLER FOR OPERATING A GAS BURNER APPLIANCE

CROSS-REFERENCE TO RELATED APPLICATIONS

This application is a U.S. National Phase patent application under 35 U.S.C. § 371 of International Application No. PCT/EP2022/074782, filed Sep. 7, 2022, which claims the benefit of and priority to EP patent application Ser. No. 21/198,885.2, filed Sep. 24, 2021. The entire contents of each of these applications are incorporated herein by reference.

The invention relates to a method for operating a gas burner appliance. Further on, the invention relates to a controller for operating a gas burner appliance.

EP 2 667 097 A1 discloses a method for operating a gas burner appliance. During burner-on-phases in a regular combustion mode of the gas burner appliance, after combustion has been started in connection with a burner-start-up, a gas/air mixture having a defined mixing ratio of gas and air is provided to a combustion chamber for combusting the gas/air mixture. The mixing ratio of gas and air of the gas/air mixture corresponds to the so-called λ-value of the gas/air mixture. The gas/air mixture is provided by a mixing device mixing an air flow provided by an air duct with a gas flow provided by a gas duct. The mixing device may be provided by a Venturi nozzle. The air flow flowing through the air duct is provided by fan in such a way that the nominal fan speed of the fan depends on a nominal burner-load of the gas burner appliance, wherein the nominal burner-load corresponds to a nominal heat demand. The fan speed range of the fan defines a so-called modulation range of the gas burner appliance. According to EP 2 667 097 A1, the defined mixing ratio of gas and air and thereby the λ-value of the gas/air mixture is kept constant over the entire modulation range of the gas burner appliance by a pneumatic gas flow regulator. The pneumatic gas flow regulator is provided by a gas armature. In addition to the pneumatic gas flow regulator, the gas armature comprises a safety gas valve and a throttle used for calibration. The pneumatic gas flow regulator uses a pressure difference between the gas pressure of the gas flow in the gas duct and a reference pressure, wherein either the air pressure of the air flow in the air duct or the ambient pressure is used as reference pressure, and wherein the pressure difference between the gas pressure of the gas flow in the gas duct and the reference pressure is determined and controlled pneumatically. EP 2 667 097 A1 discloses a method for operating a gas burner appliance in which the defined mixing ratio of the gas/air mixture is kept constant over the entire modulation range of the gas burner. This is done by the pneumatic gas flow regulator establishing a pneumatic control to keep the mixing ratio of gas and air within the gas/air mixture constant.

Instead of using pneumatic gas flow regulator, it is also known from prior art to control the mixing ratio of gas and air within the gas/air mixture by an electric or electronic gas flow modulator. The invention relates to a gas burner control making use of such an electric or electronic gas flow modulator.

DE 198 24 521 A1, DE 199 22 226 C1 and EP 2 685 168 A1 all discloses a method to control the mixing ratio of gas and air of the gas/air mixture and thereby the λ-value of the gas/air mixture on basis of a signal provided by an electrical or electronic sensor like an anemometer. An actual value corresponding to a pressure ratio between a gas pressure in a gas duct and an air pressure in an air duct or corresponding to a pressure ratio between the gas pressure in the gas duct and the air pressure at the reference point is provided by the electrical or electronic sensor, wherein this actual value is compared with a nominal value. A control variable for the electric or electronic gas flow modulator is generated on basis of the control deviation between the actual value and nominal value, wherein the electric gas flow modulator is adjusted on basis of this control variable to control the defined mixing ratio of gas and air in the gas/air mixture thereby keeping the λ-value of the gas/air mixture constant. In DE 198 24 521 A1 the electrical or electronic sensor is connected between the gas duct and the air duct. According to DE 199 22 226 C1 and EP 2 685 168 A1 the electrical or electronic sensor is connected between the gas duct and a reference point.

EP 1 248 044 B1 discloses a method for starting up a gas burner appliance. For a burner start the gas burner appliance is operated with a burner load being smaller than the burner load of a nominal heat demand and being larger than a minimum burner load.

WO 2021/078 949 A1 discloses another method for operating a gas burner appliance. During a burner start the gas burner appliance is operated at a first λ-value and after the burner start during regular combustion the gas burner appliance is operated at a second λ-value, wherein the first λ-value for the burner start is larger than the second λ-value for regular combustion after the burner start.

JP 2 800 474 B2 discloses additional prior art.

As mentioned above, the amount of the air flow and thereby the amount of the flow of the gas/air mixture having the defined mixing ratio of gas and air provided to the burner chamber depends on the desired burner load. The nominal burner-load corresponds to a desired heat demand. The nominal burner-load defines the fan speed at which the fan is operated. The fan speed range of the fan of the gas burner appliance defines the modulation range of the gas burner appliance.

A maximum fan speed of the fan defines the maximum burner-load of the gas burner appliance. If a desired heat demand requires maximum burner load, then the fan is operated at maximum fan speed. If a desired heat demand requires burner-load being 50% of the maximum burner load, then the fan is operated at 50% of the maximum fan speed. If a desired heat demand requires burner-load being 20% of the maximum burner load, then the fan is operated at 20% of the maximum fan speed.

As mentioned above, at any heat demand and thereby at any burner load of the gas burner appliance and at any fan speed of the fan the mixing ratio of gas and air of the gas/air mixture is kept at a defined value, preferably constant.

If no heat demand is present, the gas burner appliance is in a burner-off-phase in which no gas is combusted. If a heat demand occurs with the gas burner appliance being in a burner-off-phase, the gas burner appliance needs to be started by igniting a gas/air mixture. After the burner start, namely after igniting the gas/air mixture, the gas burner appliance combusts gas in a burner-on-phase.

The burner start of a gas burner appliance needs to be safe, particularly when as gas hydrogen becomes combusted.

The present invention provides a method for operating a gas burner appliance, providing a safe burner start even if hydrogen becomes combusted as gas.

If during an actual burner-on-phase of the gas burner appliance the actual nominal heat demand of the gas burner appliance is no longer present, the following steps are automatically executed in order to set-up the gas burner appliance for an upcoming burner start: Decrease during the actual burner-on-phase the opening position of the gas flow modulator. Keep the gas flow modulator at said decreased opening position and terminate the actual burner-on-phase of the gas burner appliance. The opening position of the gas flow modulator is decreased by decreasing the fan speed of the fan to a defined fan speed while keeping the mixing ratio of gas and air of the of the gas/air mixture at the defined mixing ratio through the controller. So, in order to set-up the gas burner appliance for an upcoming burner start, the fan speed will be automatically decreased to the defined fan speed and thereby also the opening position of the electric or electronic gas flow modulator will be automatically decreased to the decreased opening position. This allows a safe upcoming burner start of the gas burner appliance, even if hydrogen becomes combusted as gas. The mixing ratio and thereby λ-value of the gas/air mixture used for the upcoming burner start being defined by the decreased opening position provided a lean gas/air mixture has a relatively high λ-value compared to the λ-value used and need after ignition during regular combustion.

Preferably, if a new actual nominal heat demand is present, the following steps are automatically executed for a burner start: Run the fan with a nominal fan speed depending on the new actual nominal heat demand of the gas burner appliance or run the fan at a predefined fixed fan speed while keeping the gas flow modulator at said decreased opening position determined during the previous burner-on-phase, thereby providing a gas/air mixture to the gas burner chamber having a mixing ratio of gas and air adapted for ignition. Ignite the gas/air mixture having the mixing ratio of gas and air adapted for ignition. After ignition of the gas/air mixture, adapt the opening position of the electric or electronic gas flow modulator such that the gas/air mixture has the defined mixing ratio of gas and air needed for regular combustion. This allows a safe burner start of the gas burner appliance, even if hydrogen becomes combusted as gas, and a stable combustion after the burner start.

The controller for operating a gas burner appliance according to the present invention is defined in claim 10.

Preferred developments of the invention are provided by the dependent claims and the description which follows.

Exemplary embodiments are explained in more detail on the basis of the drawing, in which.

The present invention relates to a method and a controller for operating a gas burner appliance.

Figure 1:
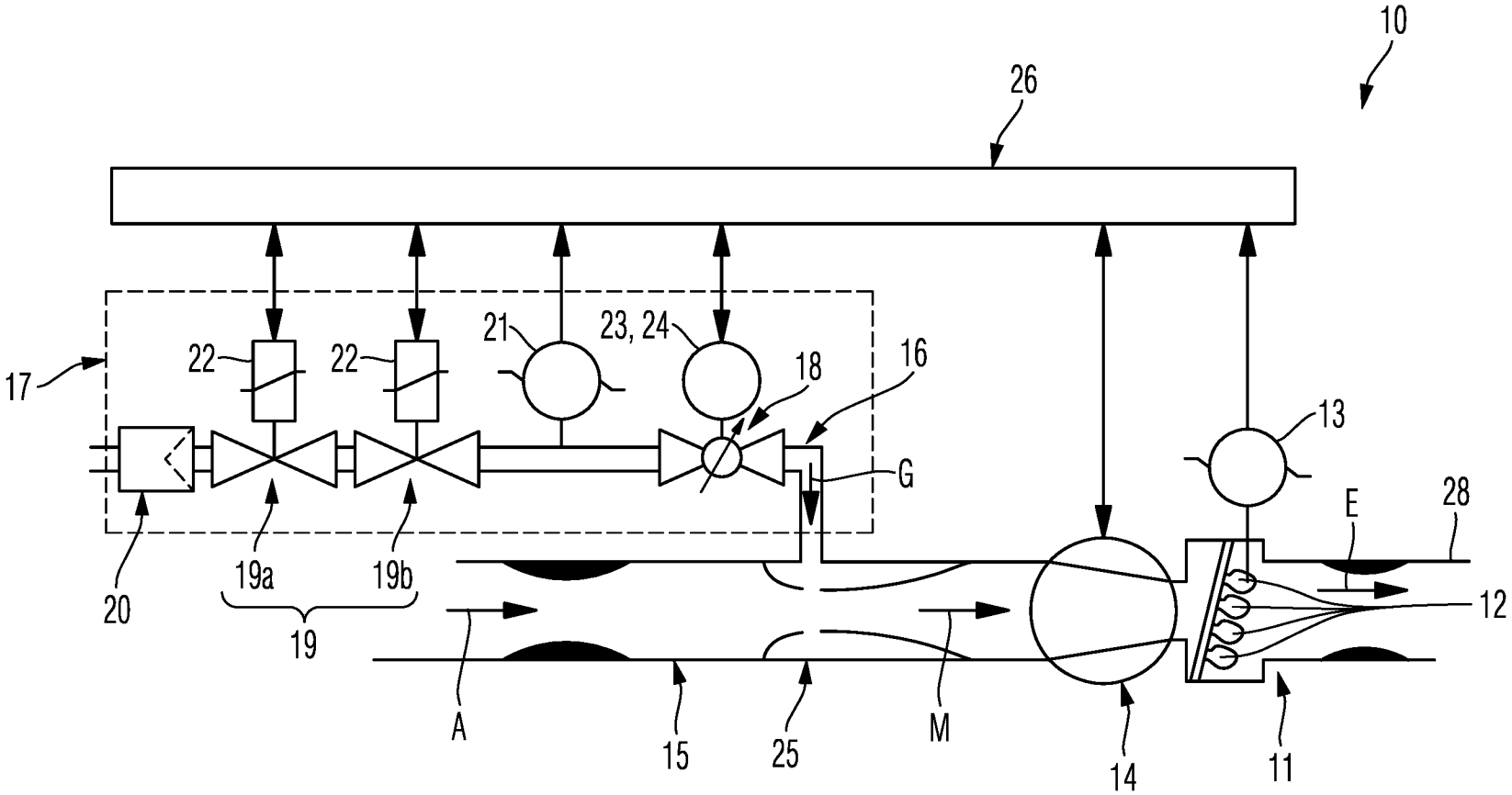
FIG. 1 shows a first gas burner appliance to be controlled by the method and controller of the present invention.

FIG. 1 shows a schematic view of a first exemplary gas burner appliance 10. The gas burner appliance 10 comprises a combustion chamber 11 in which combustion of a gas/air mixture M having a defined mixing ratio of gas G and air A takes place during a regular combustion mode of the gas burner appliance 10, namely after a start-up of the gas burner appliance 10 and after successfully igniting the gas/air mixture M.

The combustion of the gas/air mixture M results into flames 12 and into exhaust gas E. The flames 12 are monitored by a combustion quality sensor, preferably by a flame ionization sensor 13 providing as output signal an electrical flame ionization current. The flame ionization sensor 13 provides its output signal to a controller 26. The exhaust gas E emanates from the combustion chamber 11 through an exhaust pipe 28.

The gas/air mixture M is provided to the combustion chamber 11 of the gas burner appliance 10 by mixing a flow of the air A with a flow of the gas G. A fan 14 sucks in air A flowing through an air duct 15 and gas G flowing through a gas duct 16.

An electrical or electronic gas flow modulator 18 being configured to adjust the gas flow through the gas duct 16 and a gas safety valve unit 19 having preferably two gas safety valves 19*a*, 19*b* are assigned to the gas duct 16.

The gas flow modulator 18 and the gas safety valves 19*a*, 19*b* are part of a gas armature 17. The gas armature 17 may further comprise a sieve 20 and a pressure sensor 21. The sieve 20 and the pressure sensor 21 are both assigned to the gas duct 16.

The gas safety valves 19*a*, 19*b* of the gas safety valve unit 19 are operated by electric coils 22 being part of the gas armature 17. In a regular combustion mode, the electric coils 22 are energized by the controller 26 to open the gas safety valves 19*a*, 19*b*. In burner-off phases the gas safety valves 19*a*, 19*b* are closed.

In FIG. 1, each gas safety valve 19*a*, 19*b* is operated by one separate electric coil 22. With the use of separate electric coils 22 it is possible to open and close the gas safety valves 19*a*, 19*b* independently from each other. Alternatively, the gas safety valves 19*a*, 19*b* may be operated commonly by a common electric coil 22.

The electrical or electronic gas flow modulator 18 is operated by a motor 23 also having an electric coil 24. In FIG. 1, the gas flow modulator 18 is an electric gas flow modulator 18 operated by the controller 26.

The gas/air mixture M having the defined mixing ratio of gas G and air A is provided to the combustion chamber 11 of the gas burner appliance 10. The gas/air mixture M is provided by mixing the air flow A provided by an air duct 15 with a gas flow G provided by a gas duct 16. The air flow and the gas flow become preferably mixed by a mixing device 25. The mixing device 25 may be a venturi nozzle.

The quantity of the air flow A and thereby the quantity of the gas/air mixture flow M is adjusted by the fan 14, namely by the speed of the fan 14. The fan speed can be adjusted on basis of a nominal burner-load. The nominal burner load corresponds to a nominal heat demand. In a regular combustion mode of the gas burner appliance 10, a nominal fan speed of the fan 14 depends on the nominal burner load. The fan 14 is operated by the controller 26. The fan speed range of the fan 14 defines a modulation range of the gas burner appliance 10. In a regular combustion mode of the gas burner appliance 10, a modulation of "1" means that the fan 14 is operated at maximum fan speed and thereby at a maximum load of the gas burner appliance 10. A modulation of "2" means that the fan 14 is operated at 50% of the maximum fan speed and a modulation of "5" means that the fan 14 is operated at 20% of the maximum fan speed. By changing the fan speed of the fan 14, the burner-load of the gas burner appliance 10 can be adjusted.

In a regular combustion mode of the gas burner appliance 10, the defined mixing ratio of gas G and air A within the gas/air mixture M and thereby the λ-value of the gas/air mixture M is kept at a nominal value, preferably constant, over the entire modulation range of the gas burner appliance 10. Said defined mixing ratio of gas G and air A or said λ-value of the gas/air mixture M is kept at a defined value over the modulation range of the gas burner appliance 10 using the electrical or electronic gas flow modulator 18 of a gas armature 17 to keep the defined mixing ratio of gas and air and thereby the λ-value preferably constant over the modulation range of the gas burner appliance. In FIG. 1, the control variable for the electric gas flow modulator 18 in order to keep the λ-value constant is generated by the controller 26 on basis of the flame ionization signal provided by the flame ionization sensor 13. The flame ionization sensor 13 is a sensor that allows a fail-safe determination of the mixing ratio of gas G an air A of the gas/air mixture M.

Figure 2:
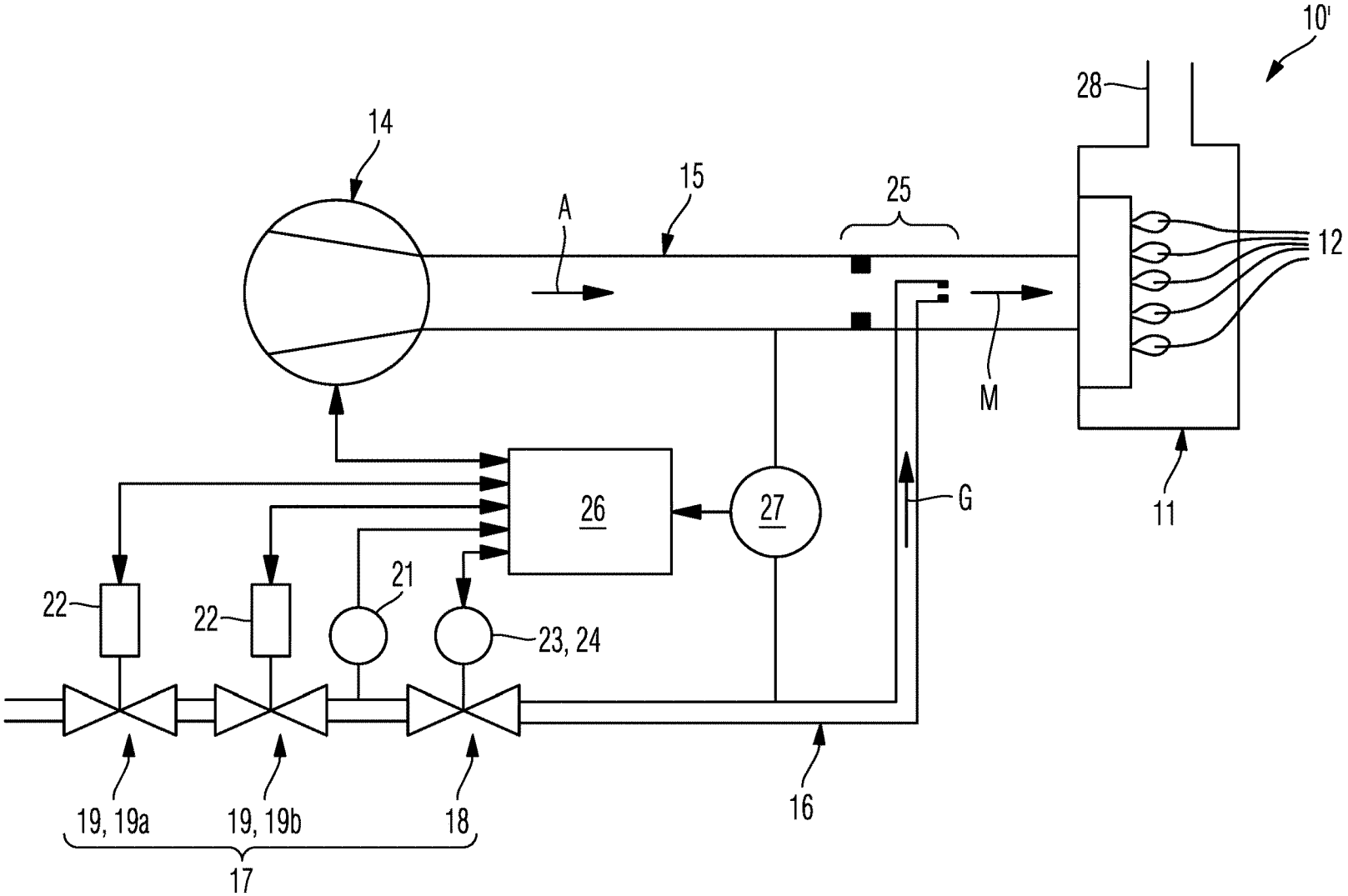
FIG. 2 shows a first gas burner appliance to be controlled by the method and controller of the present invention.

FIG. 2 a shows schematic view of other exemplary gas burner appliance 10'. In FIGS. 1 and 2 identical reference numbers are used for identical parts. In order to avoid unnecessary repetitions, below only the differences of the gas burner appliances 10, 10' will be described.

In FIG. 2, during a regular combustion mode the constant mixing ratio of gas G and air A within the gas/air mixture M is controlled by the electrical or electronic gas flow modulator 18 on basis of a signal provided by an electric or electronic pressure sensor or flow meter 27 and not on basis of the flame ionization current provided by the flame ionization sensor 13.

In FIG. 2 the electric or electronic sensor 27 may provide to the controller 26 an actual value corresponding to a pressure ratio between a gas pressure in a gas duct 16 and an air pressure in an air duct 15 or corresponding to a pressure ratio between the gas pressure in the gas duct 16 and the air pressure at the reference point, wherein the controller 26 may compare said actual value with a nominal value. In this case, the controller 26 may generate the control variable for the electric gas flow modulator 18 on basis of the control deviation between the actual value and the nominal value, wherein the gas flow modulator 18 may be operated on basis of this control variable to keep over the entire modulation range of the gas burner appliance 10 the defined mixing ratio of gas and air and thereby the λ-value at a defined value, preferably constant. The electric or electronic sensor 27 allows a fail-safe determination of the mixing ratio of gas G an air A of the gas/air mixture M.

The present invention provides a method for operating gas burner appliances 10, 10'. The invention is preferably used in combination with the gas burner appliances 10, 10' shown in FIGS. 1 and 2. However, the invention may also be used to operate other gas burner appliances making use of an electric or electronic gas flow modulator and of an electrical or electronic sensor that allows a fail-safe determination of the mixing ratio of gas G an air A of the gas/air mixture M.

As mentioned above, during an actual burner-on-phase of the gas burner appliance 10, 10'—in request to an actual nominal heat demand—a flow of the gas/air mixture M is provided to the burner chamber 11 of the gas burner appliance 10, 10', the gas/air mixture M having a defined mixing ratio of gas G and air A needed for a regular combustion of the gas/air mixture M within the burner chamber 11. Said gas/air mixture M is provided by the mixing device 25 of the gas burner appliance 10, 10' mixing the air flow with the gas flow.

The air flow or the flow of the gas/air mixture M is provided by the fan 14 of the gas burner appliance 10, 10' in such a way that the fan speed of the fan 14 depends on the actual nominal heat demand of the gas burner appliance 10, 10'.

Said defined mixing ratio of gas G and air A of the gas/air mixture M is controlled by a controller 26 using as input a signal provided by the sensor 13, 27 and providing as output a control variable for an electric or electronic gas flow modulator 18 in order to keep the mixing ratio of gas G and air A of the gas/air mixture M at the defined mixing ratio over the modulation range of the gas burner appliance 10, 10'.

If the actual nominal heat demand of the gas burner appliance 10, 10' is no longer present, the following steps i) and ii) are automatically executed by the controller 26 in order to set-up the gas burner appliance 10, 10' for an upcoming burner start.

Step i): Decrease automatically during the actual burner-on-phase the opening position of the electrical or electronic gas flow modulator 18. This is done by decreasing automatically the fan speed of the fan 14 to a defined fan speed while the controller 26 automatically keys the mixing ratio of gas G and air A of the of the gas/air mixture M at the defined mixing ratio on basis of the the signal provided by the sensor 13, 27. Said defined fan sped may by the minimum fan speed of the fan 14 corresponding to the minimum burner-load of the gas burner appliance 10, 10'.

Step ii): Keep the electrical or electronic gas flow modulator 18 at said decreased opening position and terminate the actual burner-on-phase of the gas burner appliance 10, 10'. For the termination of the actual burner-on-phase of the gas burner appliance 10, 10' the fan 14 becomes switched off. Further, for the termination of the actual burner-on-phase of the gas burner appliance 10, 10' the gas safety valves 22 being assigned to a gas duct 16 become closed while keeping the electric or electronic gas flow modulator 18 at said decreased opening position.

If a new actual nominal heat demand is present, the following steps iii), iv) and v) are automatically executed by the controller 26 for a burner start of the gas burner appliance 10, 10'.

Step iii): Run the fan 14 with a nominal fan speed depending on the new actual nominal heat demand of the gas burner appliance 10, 10' or a run the fan 14 at a predefined fixed fan speed while keeping the electrical or electronic gas flow modulator 18 at said decreased opening position determined during the previous burner-on-phase, thereby providing a gas/air mixture M to the gas burner chamber 11 having a mixing ratio of gas G and air A being adapted for ignition.

Step iv): Ignite the gas/air mixture M having the mixing ratio of gas G and air A adapted for ignition.

Step v): After the ignition of the gas/air mixture M, adapt the opening position of the electric or electronic gas flow modulator 18 such that the gas/air mixture M has the defined mixing ratio of gas G and air A needed for regular combustion.

The invention allows a safe burner start of the gas burner appliance 10, 10' even if hydrogen becomes combusted as gas. Most preferably, the invention is used for operating a gas burner appliance 10, 10' combusting as gas hydrogen.

The invention further provides the controller 26 being configured to operate the gas burner appliance 10, 10' according to the above method. The controller 26 is configured to automatically execute the following steps if the actual nominal heat demand of the gas burner appliance 10, 10' is no longer present in order to set-up the gas burner appliance 10, 10' for an upcoming burner start: Decrease during the actual burner-on-phase the fan speed of the fan 14 to a defined fan speed while keeping the mixing ratio of gas G and air A of the gas/air mixture M at the defined mixing ratio thereby decreasing the opening position of the electric or electronic gas flow modulator 18. Keep the electric or electronic gas flow modulator 18 at said decreased opening position and terminate the actual burner-on-phase of the gas burner appliance 10, 10'.

LIST OF REFERENCE SIGNS

10 gas burner appliance
10' gas burner appliance

11 combustion chamber
12 flame
13 flame ionization sensor
14 fan
15 air duct
16 gas duct
17 gas armature
18 gas flow modulator
19 safety gas valve unit
19*a* safety gas valve
19*b* safety gas valve
20 sieve
21 pressure sensor
22 coil
23 motor
24 coil
25 mixer
26 controller
27 electric or electronic sensor
28 exhaust pipe

The invention claimed is:

1. A method for operating a gas burner appliance, by providing during an actual burner-on-phase of the gas burner appliance in request to an actual nominal heat demand a flow of a gas/air mixture (M) to a burner chamber of the gas burner appliance, the gas/air mixture (M) having a defined mixing ratio of gas (G) and air (A) needed for a regular combustion of the gas/air mixture (M) within the burner chamber, wherein the gas/air mixture (M) is provided by a mixing device of the gas burner appliance mixing an air flow with a gas flow, wherein the air flow or the flow of the gas/air mixture is provided by a fan of the gas burner appliance in such a way that a fan speed of the fan depends on the actual nominal heat demand of the gas burner appliance (10, 10'), wherein a fan speed range of the fan defines a modulation range of the gas burner appliance (10, 10'), wherein said defined mixing ratio of gas (G) and air (A) of the gas/air mixture (M) is controlled by a controller using as input a signal provided by a sensor and providing as output a control variable for an electric or electronic gas flow modulator in order to keep the mixing ratio of gas (G) and air (A) of the gas/air mixture (M) at the defined mixing ratio over the modulation range of the gas burner appliance, wherein:

if the actual nominal heat demand of the gas burner appliance is no longer present, the following steps are automatically executed in order to set-up the gas burner appliance for an upcoming burner start:

decrease during the actual burner-on-phase the fan speed of the fan to a defined fan speed while keeping the mixing ratio of gas (G) and air (A) of the gas/air mixture (M) at the defined mixing ratio thereby decreasing the opening position of the electric or electronic gas flow modulator, keep the electric or electronic gas flow modulator at said decreased opening position and terminate the actual burner-on-phase of the gas burner appliance.

2. The method of claim 1, wherein:

the fan speed of the fan is decreased to a minimum fan speed of the fan corresponding to a minimum burner load.

3. The method of claim 1, wherein:

for the termination of the actual burner-on-phase of the gas burner appliance the fan is switched off and gas safety valves being assigned to a gas duct are closed while keeping the electric or electronic gas flow modulator at said decreased opening position.

4. The method of claim 1, wherein:

if a new actual nominal heat demand is present the following steps are automatically executed for a burner start:

run the fan with a nominal fan speed depending on the new actual nominal heat demand of the gas burner appliance or a run the fan at a predefined fixed fan speed while keeping the electric or electronic gas flow modulator at the decreased opening position thereby providing a gas/air mixture (M) to the gas burner chamber having a mixing ratio of gas (G) and air (A) adapted for ignition, ignite the gas/air mixture (M) having the mixing ratio of gas (G) and air (A) adapted for ignition, after ignition of the gas/air mixture (M) adapt the opening position of the electric or electronic gas flow modulator such that the gas/air mixture (M) has the defined mixing ratio of gas (G) and air (A) needed for regular combustion.

5. The method of claim 1, wherein hydrogen is provided as gas (G).

6. The method of claim 1, wherein the sensor providing the input to the controller is an electrical or electronic sensor that allows a fail-safe determination of the mixing ratio of gas (G) an air (A) of the gas/air mixture (M).

7. The method of claim 1, wherein the sensor providing the input to the controller is a flame ionization sensor.

8. The method of claim 1, wherein the sensor providing the input to the controller is an electrical or electronic sensor connected between the gas duct and a reference point.

9. The method of claim 1, wherein the sensor providing the input to the controller is an electrical or electronic sensor connected between the gas duct and the air duct.

10. A controller of a gas burner appliance for operating the gas burner appliance, wherein the controller is configured to execute the following steps if an actual nominal heat demand of the gas burner appliance is no longer present in order to set-up the gas burner appliance for an upcoming burner start:

decrease during the actual burner-on-phase the fan speed of the fan to a defined fan speed while keeping the mixing ratio of gas (G) and air (A) of the gas/air mixture (M) at the defined mixing ratio thereby decreasing the opening position of an electrical or electronic gas flow modulator, keep the electrical or electronic gas flow modulator at the decreased opening position and terminate the actual burner-on-phase of the gas burner appliance.

11. The controller of claim 10, wherein:

the controller is configured to operate the gas burner appliance according to the method of claim 1.

* * * * *